United States Patent [19]

Woodhull, Jr. et al.

[11] 4,243,094

[45] Jan. 6, 1981

[54] CONDENSER HEADER CONSTRUCTION

[75] Inventors: Ivan D. Woodhull, Jr., Flat Rock; Thomas H. Liedel, Maybee, both of Mich.

[73] Assignee: Karmazin Products Corporation, Wyandotte, Mich.

[21] Appl. No.: 2,723

[22] Filed: Jan. 11, 1979

Related U.S. Application Data

[62] Division of Ser. No. 789,412, Apr. 21, 1977, Pat. No. 4,141,409.

[51] Int. Cl.[3] ..... F28B 9/08

[52] U.S. Cl. ..... 165/114; 165/146; 165/174

[58] Field of Search ..... 165/110, 111, 114, 146, 165/174, 176, 113, DIG. 24

[56] References Cited

U.S. PATENT DOCUMENTS

| | | | |
|---|---|---|---|
| 1,200,996 | 10/1916 | Söderlund et al. | 165/146 |
| 2,867,416 | 1/1959 | Lieberherr | 165/176 |
| 3,675,710 | 7/1972 | Ristow | 165/111 |
| 4,141,410 | 2/1979 | Takada | 165/146 |

FOREIGN PATENT DOCUMENTS

| | | | |
|---|---|---|---|
| 4049 | 5/1901 | Austria | 165/114 |
| 284413 | 2/1928 | United Kingdom | 165/117 |

*Primary Examiner*—Sheldon Richter
*Attorney, Agent, or Firm*—Harness, Dickey & Pierce

[57] ABSTRACT

There is disclosed herein an improved multipass condenser construction having provisions therein which allow the condensate formed from each pass through the core portion thereof to by-pass substantially all of the remaining core portions thereby promoting maximum efficiency of the condenser. The condenser comprises a pair of vertically extending headers each having a plurality of baffles provided therein and an interconnecting core structure. The baffles are arranged so as to cause a gaseous fluid to flow through the core structure in alternating directions so as to be cooled and condensed to a liquid state. Each of the baffles is provided with a small aperture which allows condensate formed from each pass of the gaseous fluid through the core structure to by-pass the remaining portions of the core and flow directly to the lower end of the headers. Also, in that the volume of fluid to be passed through the core structure is constantly being reduced due to the separation of the condensate and the cooling of the gaseous fluid, successively fewer fluid conducting members are provided for successive flow paths while still maintaining the same overall flow capacity for the condenser unit.

5 Claims, 3 Drawing Figures

CONDENSER HEADER CONSTRUCTION

This is a division of application Ser. No. 789,412, filed Apr. 21, 1977, now U.S. Pat. No. 4,141,409.

BACKGROUND AND SUMMARY OF THE INVENTION

The present invention relates generally to condensers and more specifically to such condensers having multiple counterflow paths for condensing a gaseous fluid to a liquid state.

Condensers are employed in a variety of applications and normally are designed to receive a gaseous fluid at a relatively high temperature and pressure and to cool this fluid so as to transform it into a liquid state with as little pressure drop as possible.

A typical condenser construction in present day use employes a plurality of finned conduits extending between headers having fluid inlet and outlet connections provided therein. Baffles may be provided in the headers to provide any desired number of counterflow paths for the fluid passing therethrough. Generally such counterflow condensers provide equal number of fluid conduits for each pass through the condenser. Further, as these baffles are sealed in place, they divide the header into separate chambers thus requiring that any fluid condensed during the initial passes through the conduits continue to flow back and forth through the conduits to reach the outlet connection. This liquid fluid tends to insulate portions of those conduits through which it flows from effective heat transfer relationship with the gaseous portions of the fluid thus significantly impairing the effectiveness of subsequent flow paths. Further, providing equal numbers of conduits for both initial and subsequent counterflow paths is inefficient in that as the gaseous fluid is cooled its volume will decrease thus requiring a lesser number of conduits to achieve the same flow rate.

Accordingly, the present invention provides an improved condenser of the counterflow path type by providing an alternative flow path to direct fluid condensed by each pass through the finned condiuts directly to the outlet connection. Further, as finned conduits are not required to conduct the condensed fluid to the outlet connection, the present invention provides progressively fewer finned conduits for successive flow paths thus optimizing the flow rate through the entire condenser and effectively utilizing the entire heat transfer capability of each conduit member. Also, the reduction in volume due to the cooling of the gaseous fluid allows lesser numbers of finned conduit members to be utilized in successive passes through the condenser without any impairment of overall condenser efficiency or any increased pressure drop therethrough. Thus, the combination of alternative liquid flow paths and decreasing the conduit members in successive flow paths allow smaller condensers to be fabricated with the same heat transfer capability. Significant cost savings will be realized both in the reduction of materials required to fabricate these smaller condensers as well as through the reduced mounting space required therefor.

Additional advantages and features of the present invention will become apparent from the subsequent description of the preferred embodiment taken in conjunction with the drawings and claims appended hereto.

DESCRIPTION OF THE PREFERRED EMBODIMENT

Figure 1:
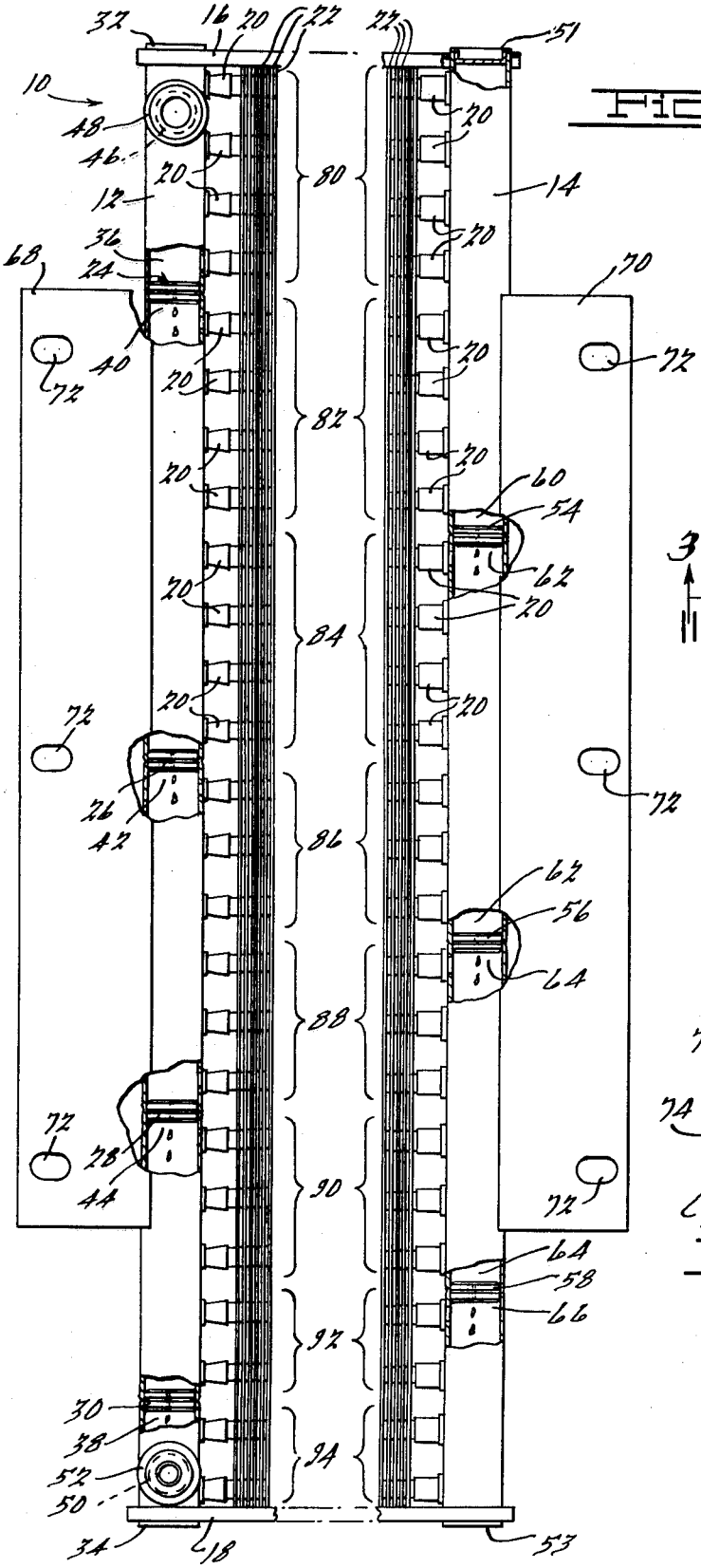
FIG. 1 is an elevational view of a condenser in accordance with the present invention having portions thereof broken away.

Referring now to FIG. 1, there is shown a condenser in accordance with the present invention indicated generally at 10 and comprising a pair of substantially parallel spaced apart headers 12 and 14 interconnected by upper and lower frame members 16 and 18 secured to opposite ends thereof. A plurality of conduit members 20 extend between headers 12 and 14 and have their respective ends sealingly connected in fluid communication with respective headers 12 and 14. A plurality of substantially parallel spaced apart heat radiating fins 22 surround each of the conduit members 20.

Conduit members 20 and heat radiating fins 22 of condenser 10 illustrated in FIG. 1 are fabricated by arranging a plurality of sheets having integrally formed tapered tubular projections formed therein in a stacked nested relationship and subjecting the assembly to a brazing process so as to seal the joints therebetween. It should, however, be noted that the present invention may be easily incorporated into other condenser constructions such as for example the type having separately fabricated conduits to which heat radiating fins are assembled or even those omitting heat radiating fins altogether.

Header 12 is hollow and cylindrical in shape and may be fabricated from an elongated tubular member. Four baffle members 24, 26, 28 and 30 are disposed within header 12 in a nonuniform spaced apart relationship. The opposite ends 32 and 34 are sealed by suitable plugs secured therein which in combination with baffles 24 and 30 define respective inlet and outlet chambers 36 and 38 therein. Baffles 26 and 28 are secured within header 12 between baffles 24 and 30 and define chambers 40, 42 and 44 therein.

An opening 46 is provided adjacent upper end portion 32 of header 12 having an inlet connection 48 secured therein. Similarly, a second opening 50 is provided in header 12 adjacent lower end 34 in which is secured an outlet connection 52. Inlet and outlet connections 48 and 52 will typically be in the form of a relatively short tubular member adapted to have a fluid supply line sealingly connected thereto.

Header 14 is of a similar construction to header 12 having suitable plugs or the like sealing opposite ends 51 and 53 and includes three baffles 54, 56 and 58 also secured in a nonuniform spaced apart relationship therein so as to divide the interior thereof into chambers 60, 62, 64 and 66.

A pair of mounting brackets 68 and 70 are secured to respective headers 12 and 14 and are provided with a plurality of openings 72 adapted to receive bolts or other suitable fasteners for mounting condenser 10 in a desired operative position. Mounting brackets 68 and 70 may be of any desired size and shape suitable for the intended mounting arrangement and will generally be secured to headers 12 and 14 by welding or brazing.

Figure 2:
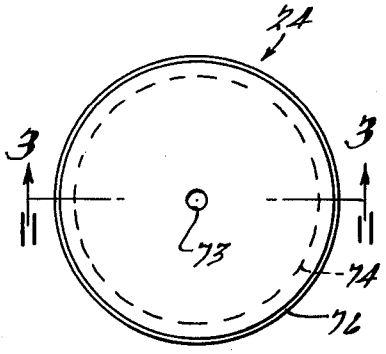
FIG. 2 is an enlarged view of a baffle employed in the condenser of FIG. 1.
Figure 3:
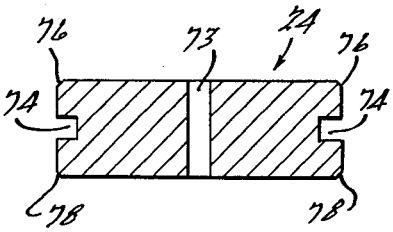
FIG. 3 is a sectional view of the baffle of FIG. 2, the section being taken along line 3—3 thereof.

Baffles 24 through 30 and 54 through 58 are all substantially identical and therefore only one such baffle will be described in detail. Baffle 24, as illustrated in FIGS. 2 and 3, is generally round in shape, of a generous thickness and has a diameter substantially equal to or slightly less than the inside diameter of headers 12 and 14. A relatively small bore 73 is preferably centrally disposed therein and extending axially therethrough. The function of opening 73 will be described in greater detail below. A shallow annular groove 74 is also provided around the circumference thereof and serves to aid in securing baffle 24 within header 12. In order to facilitate assembly of baffle 24 into header 12, circumferential edge portions 76 and 78 thereof are beveled slightly.

A gaseous fluid, which is to be condensed, is supplied through inlet connection 48 to inlet chamber 36 at an elevated pressure and temperature. Baffle member 24 prevents the fluid from flowing longitudinally out of inlet chamber 36 thus forcing the fluid to flow through a first group 80 of conduit members 20 into chamber 60 of header 14. Baffle member 54 disposed therein prevents the fluid from flowing longitudinally from chamber 60 thus directing the fluid through a second group 82 of conduit members 20 into chamber 40 of header 12. The fluid is then similarly conducted between successive chambers 62, 42, 64, 44, 66 and 38 of alternating headers 12 and 14 through successive groups 84, 86, 88, 90, 92 and 94 of conduit members 20 until the fluid reaches outlet connection 52 which conducts the condensed fluid out of condenser 10 and through a second fluid supply line.

As the fluid is conducted through successive groups of conduit members 20, heat is conducted outwardly therefrom through conduit members 20 and heat radiating fins 22 thus causing the fluid to be transformed from a gaseous state to a liquid state. The gaseous fluid immediately adjacent the sidewalls of conduit members 20 will be more rapidly cooled than the fluid disposed more radially inwardly thus causing portions of the gaseous fluid to be condensed to a liquid state during each pass through conduit members 20. This liquid fluid, if allowed to continue flowing through conduit members 20, will decrease the overall efficiency in that it will tend to insulate a portion of the sidewalls of the conduit members from the gaseous fluid. Accordingly, the bores 73 in each of baffles 24 through 30 and 54 through 58 allow condensed liquid to by-pass substantially all the remaining conduit members 20 and flow directly to the lower ends 34 and 56 of respective headers 12 and 14.

Bores 73 are of a size which allows the condensed liquid to flow therethrough by capillary action but will effectively prevent gaseous fluid from passing therethrough. Further, in that the condenser is designed to be mounted with the longitudinal axis of the headers disposed in a vertical plane, the condensed fluid will collect in the bottom of each chamber thus preventing communication between the gaseous fluid and bores 73 and thereby further insuring that only fluid in a liquid state will be passed therethrough.

The liquid fluid in the lower end of header 14 will flow through the lower conduit members 20 of group 94 to outlet connection 52. This liquid will not appreciably affect the efficiency of the condenser at this stage as only a small amount of gaseous fluid will remain to be condensed in this last flow path.

As is shown in FIG. 1, groups 80, 82 and 84 are each comprised of four conduit members 20 while groups 86, 88 and 90 have only three such conduit members and groups 92 and 94 have but two each. This arrangement allows the condenser of the present invention to take full advantage of both the reduction in volume of the gaseous fluid due to cooling thereof as well as the elimination of the condensed fluid which is directed through bores 73 of respective baffle members. Thus, the present invention allows the overall size of the condenser to be effectively reduced without any increase in pressure drop of fluid flowing therethrough and still maintain the same overall fluid capacity thereof.

It should be noted that the particular numbers of conduit members 20 illustrated in FIG. 1 are representative only. The actual numbers to be employed in a particular condenser will be easily determined on the basis of the design parameters and fluid to be condensed in the particular application. It should also be noted that while only a single vertical row of conduit members are shown, any desired number of vertical rows may also be provided in like manner. It should also be noted that while condenser 10 has been described as being positioned with the headers extending vertically, condenser 10 may also be installed with the headers extending horizontally and will still offer the same operative advantages described above. Additionally, inlet and outlet connections 48 and 52 respectively may be positioned on the same or different headers. However, when the headers are in a horizontal plane, outlet connection 52 should be provided in the lower header. Also, it may be desirable to position bore 73 in each of the baffle members off-center toward the lower circumferential edge thereof or even to position it in intersecting relationship with the circumference.

While it is apparent that the preferred embodiment of the invention disclosed is well calculated to provide the advantages above stated, it will be appreciated that the invention is susceptible to modification, variation and change without departing from the proper scope or fair meaning of the subjoined claims.

We claim:

1. A condenser comprising:

a plurality of substantially parallel fluid conducting members adapted to place one fluid in heat transferring relationship with another fluid so as to transform said one fluid from a gaseous state to a liquid state;

an elongated header member;

a baffle member secured within said header member defining a first and second chamber therein;

a first predetermined number of said conduit members having one end secured to said header member in fluid communication with said first chamber;

a second predetermined number of said conduit members having one end secured to said header member in fluid communication with said second chamber;

said second predetermined number being less than said first predetermined number and receiving said one fluid subsequent to said first predetermined number;

said baffle member having an opening extending therethrough, said opening being of a size to enable said one fluid in said liquid state to pass between said first and second chambers by capillary action.

2. A condenser as set forth in claim 1 wherein said means comprise a small bore extending through said baffle.

3. A condenser as set forth in claim 1 wherein said header is vertically disposed and said baffle extends transversely therein.

4. A condenser as set forth in claim 3 wherein said header has a fluid inlet connection at the upper end thereof and a fluid outlet connection at the lower end thereof.

5. A condenser as set forth in claim 1 wherein said first predetermined number of conduit members include a first group conducting fluid into said first chamber and a second group conducting fluid out of said first chamber, said first group having a greater number of conduit members than said second group.

* * * * *